US009025302B2

(12) United States Patent
Hariya et al.

(10) Patent No.: US 9,025,302 B2
(45) Date of Patent: May 5, 2015

(54) IONIZER

(71) Applicant: SMC Kabushiki Kaisha, Chiyoda-ku (JP)

(72) Inventors: Tomokazu Hariya, Noda (JP); Satoshi Kitano, Joso (JP); Naoto Sasada, Taito-ku (JP)

(73) Assignee: SMC Kabushiki Kaisha, Chiyoda-ku (JP)

( * ) Notice: Subject to any disclaimer, the term of this patent is extended or adjusted under 35 U.S.C. 154(b) by 0 days.

(21) Appl. No.: 13/966,680

(22) Filed: Aug. 14, 2013

(65) Prior Publication Data

US 2014/0071579 A1 Mar. 13, 2014

(30) Foreign Application Priority Data

Sep. 10, 2012 (JP) ..... 2012-198033

(51) Int. Cl.
*H01T 23/00* (2006.01)

(52) U.S. Cl.
CPC ..... *H01T 23/00* (2013.01)

(58) Field of Classification Search
USPC ..... 361/230
See application file for complete search history.

(56) References Cited

U.S. PATENT DOCUMENTS

| | | | | |
|---|---|---|---|---|
| 6,850,403 | B1 * | 2/2005 | Gefter et al. | 361/230 |
| 7,180,722 | B2 * | 2/2007 | Jacobs et al. | 361/231 |
| 2012/0224293 | A1 * | 9/2012 | Partridge et al. | 361/230 |
| 2012/0257318 | A1 * | 10/2012 | Fujita | 361/212 |

FOREIGN PATENT DOCUMENTS

| | | |
|---|---|---|
| JP | 10-64691 | 3/1998 |
| JP | 10-108480 | 4/1998 |
| JP | 2000-58290 | 2/2000 |
| JP | 2007-66770 | 3/2007 |
| JP | 2009-193793 A | 8/2009 |

OTHER PUBLICATIONS

Hayakawa Daisuke, Static Eliminator, Publication Date: Mar. 15, 2007, Specifications. Drawings 1, 3.*
JP-2007-066770; Abstract, Specification, Fig. 3.*
Office Action issued Aug. 20, 2013 in Japanese Patent Application No. 2012-198033 (with the English translation of pertinent portion).

* cited by examiner

*Primary Examiner* — Dharti Patel
(74) *Attorney, Agent, or Firm* — Oblon, McClelland, Maier & Neustadt, L.L.P.

(57) ABSTRACT

In an ionizer, two output resistors are connected to a needle electrode through a switch unit. DC high voltage generating circuits, respectively, generate DC high voltages continuously during operation of the ionizer. A first switch and a second switch, which constitute the switch unit, are turned ON in mutually different time bands, respectively.

6 Claims, 4 Drawing Sheets

IONIZER

CROSS-REFERENCE TO RELATED APPLICATION

This application is based upon and claims the benefit of priority from Japanese Patent Application No. 2012-198033 filed on Sep. 10, 2012, the contents of which are incorporated herein by reference.

BACKGROUND OF THE INVENTION

1. Field of the Invention

The present invention relates to an ionizer, which generates ions in the vicinity of an electrode by application of a voltage to the electrode.

2. Description of the Related Art

In Japanese Laid-Open Patent Publication No. 10-064691, Japanese Laid-Open Patent Publication No. 2000-058290, and Japanese Laid-Open Patent Publication No. 2007-066770, technologies are disclosed in which ions are generated in the vicinity of electrodes by application of high voltages to the electrodes, and the generated ions are released toward an object to be neutralized, whereby static charges that charge the object can be removed and the object is neutralized.

More specifically, in Japanese Laid-Open Patent Publication No. 10-064691, it is disclosed that a high voltage of high frequency, which is generated by a high frequency oscillation circuit, is supplied to two voltage double rectifier circuits. A positive polarity DC high voltage, which is rectified by one of the voltage double rectifier circuits, is applied to one of the electrodes through one resistor, and a negative polarity DC high voltage, which is rectified by the other of the voltage double rectifier circuits, is applied to another of the electrodes through another resistor.

Further, in Japanese Laid-Open Patent Publication No. 2000-058290, a technique is disclosed in which a series circuit made up of a positive polarity high voltage generating circuit and a resistor, and a series circuit made up of a negative polarity high voltage generating circuit and a resistor are connected in parallel with respect to an individual electrode. In this case, by alternately operating the positive polarity high voltage generating circuit and the negative polarity high voltage generating circuit, positive polarity DC voltages and negative polarity DC voltages are generated alternately and applied to the electrode.

Furthermore, in Japanese Laid-Open Patent Publication No. 2007-066770, a technique is disclosed in which a series circuit made up of a positive polarity high voltage generator and a semiconductor switch, and a series circuit made up of a negative polarity high voltage generating circuit and a semiconductor switch are connected in parallel with respect to an individual electrode. In this case as well, by alternate operations of the positive polarity high voltage generator and the semiconductor switch and the negative polarity high voltage generator and the semiconductor switch, positive polarity DC voltages and negative polarity DC voltages are generated alternately and applied to the electrode.

On the other hand, in Japanese Laid-Open Patent Publication No. 10-108480, a high voltage switching circuit is disclosed, which can be applied to an ionizer. The high voltage switching circuit is constituted by a positive polarity DC voltage source and a negative polarity DC voltage source, together with four semiconductor switching elements. In this case, by controlling ON and OFF timings of the respective semiconductor switching elements, a positive polarity DC voltage and a negative polarity DC voltage are applied alternately to a load.

SUMMARY OF THE INVENTION

However, with the ionizer of Japanese Laid-Open Patent Publication No. 2000-058290, two resistors are connected in parallel with respect to the electrode. Therefore, in the event that a DC voltage is applied to the electrode through one of the DC high voltage generating circuits and the resistor, there is a possibility that a portion of the current that flows through the one resistor will flow into the other DC high voltage generating circuit via the other resistor. Consequently, the value of the voltage actually applied to the electrode decreases lower than the DC voltage generated by the one DC high voltage generating circuit. For example, assuming the two resistors are of the same resistance value, the value of the voltage applied to the electrode becomes half of the DC voltage value. As a result, the efficiency with which ions are generated in the vicinity of the electrode decreases considerably, and the charge removal capability of the ionizer with respect to charges that charge the object to be neutralized is significantly lowered.

With respect to this type of problem, it may be considered to supplement or compensate for lowering of the voltage value applied to the electrode, and thus to ensure the charge removal capability, by increasing the voltage level of the DC voltage that is generated by the one DC high voltage generating circuit. However, when the DC voltage is raised in value, the amount of generated heat (Joule heat) caused by respective currents that flow in the two resistors becomes large, and the temperature of the ionizer casing in which the DC high voltage generating circuits are housed also rises disadvantageously.

The same problems also occur in the case that the DC voltage is applied to the electrode through the other DC high voltage generating circuit and resistor.

Incidentally, it may be considered to overcome the aforementioned problems by means of a configuration in which resistors are not used, such as in the ionizer of Japanese Laid-Open Patent Publication No. 2007-066770.

However, the resistors of Japanese Laid-Open Patent Publication No. 2000-058290 serve as current limiting protective resistors, which are provided for the purpose of protecting the DC high voltage generating circuits. For this reason, if such protective resistors are not provided, the DC high voltage generating circuits cannot be suitably protected.

Further, with the techniques disclosed in Japanese Laid-Open Patent Publication No. 2000-058290 and Japanese Laid-Open Patent Publication No. 2007-066770, by alternately operating one of the DC high voltage generating circuits (and semiconductor switching element) and the other of the DC high voltage generating circuits (and semiconductor switching element), a positive polarity DC voltage and a negative polarity DC voltage are applied alternately with respect to a single electrode. For this reason, when the DC high voltage generating circuits which supply DC voltages to the electrode are switched, or more specifically, when operation of one of the DC high voltage generating circuits (and turning ON of the semiconductor switching element) is initiated together with suspending operation of the other of the DC high voltage generating circuits (and turning OFF of the semiconductor switching element), the time required for starting up operation of one of the DC high voltage generating circuits, operation of which is to be initiated, as well as the time required to discharge the other of the DC high voltage generating circuits, operation of which is to be halted, are both delayed, caused by the resistors and stray capacitance, or by the capacitors that make up the DC high voltage generating circuits and line resistance. As a result, the time required for the voltages applied to the electrode to reach a voltage value necessary for ions to be generated is delayed, and contrary to expectation, the charge removal capability is deteriorated.

Moreover, even in the case that operation of the one DC high voltage generating circuit is suspended together with initiating operation of the other DC high voltage generating circuit, the same problems are likely to occur.

The present invention has the object of providing an ionizer, which is capable of enhancing a charge removal (neutralization) capability, by controlling generation of heat from resistors that are connected to the output sides of DC high voltage generating circuits, and by shortening switching times of the two DC high voltage generating circuits and improving responsiveness.

To achieve the aforementioned object, the ionizer according to the present invention includes a first DC voltage generating circuit that generates a positive polarity DC voltage, a second DC voltage generating circuit that generates a negative polarity DC voltage, a first resistor connected to an output side of the first DC voltage generating circuit, a second resistor connected to an output side of the second DC voltage generating circuit, and a switch unit that connects the first resistor and the second resistor with the electrode.

In this case, the first DC voltage generating circuit continuously generates the positive polarity DC voltage, the second DC voltage generating circuit continuously generates the negative polarity DC voltage, the switch unit is equipped with a first switch capable of establishing a connection between the first resistor and the electrode, and a second switch capable of establishing a connection between the second resistor and the electrode, and the first switch and the second switch are turned ON in mutually different time bands, respectively.

The phrases "continuously generates the positive polarity DC voltage" and "continuously generates the negative polarity DC voltage" imply that, during operation of the ionizer, and more specifically, in a time band during which static charge removal is carried out with respect to an object to be neutralized using the ionizer, the first DC voltage generating circuit continues to output a DC voltage of positive polarity, and the second DC voltage generating circuit continues to output a DC voltage of negative polarity.

Accordingly, with the present invention, the first DC voltage generating circuit and the second DC voltage generating circuit are normally under a state of operation (i.e., an electrically energized condition). Consequently, if the first switch or the second switch is turned ON, the positive polarity DC voltage generated by the first DC voltage generating circuit, or the negative polarity DC voltage generated by the second DC voltage generating circuit can be applied without modification to the electrode.

In addition, since the first switch and the second switch are turned ON in mutually different time bands, current that flows in the first resistor can be prevented from flowing into the second DC voltage generating circuit through the second resistor, or current that flows in the second resistor can be prevented from flowing into the first DC voltage generating circuit through the first resistor.

In this manner, the value of the voltage applied to the electrode becomes the positive polarity DC voltage value or the negative polarity DC voltage value. For this reason, it becomes unnecessary to raise or step up the DC voltage for the purpose of compensating a voltage decrease, as in Japanese Laid-Open Patent Publication No. 2000-058290. Accordingly, the first DC voltage generating circuit and the second DC voltage generating circuit are capable of lowering the DC voltage to a voltage value necessary for generating ions in the vicinity of the electrode. More specifically, with the present invention, compared to the disclosure of Japanese Laid-Open Patent Publication No. 2000-058290, the DC voltage values generated by the first DC voltage generating circuit and the second DC voltage generating circuit can be reduced, while preserving and ensuring the charge removal capability of the ionizer.

As a result, values of the currents that flow respectively in the first resistor and the second resistor are decreased, thereby lowering power consumption, and the amount of heat generated by the first resistor and the second resistor can be suppressed. Consequently, a rise in the temperature of the ionizer casing, in which the first DC voltage generating circuit and the second DC voltage generating circuit are housed, can be suppressed.

Further, by means of the first switch and the second switch that make up the switch unit, the voltage supplied to the electrode is switched between a positive polarity DC voltage and a negative polarity DC voltage. Owing thereto, the timing at which the first DC voltage generating circuit and the second DC voltage generating circuit are switched (i.e., the timing at which the positive polarity DC voltage and the negative polarity DC voltage are switched) with respect to the electrode is made dependent on the switching times of the first switch and the second switch. Accordingly, by adopting as the first switch and the second switch high speed responsive switching elements, the withstand voltages of which are higher than the positive polarity DC voltage and the negative polarity DC voltage, the switching time can easily be shortened.

Further, as has been described above, with the present invention, the first DC voltage generating circuit continuously generates the positive polarity DC voltage, and the second DC voltage generating circuit continuously generates the negative polarity DC voltage. Therefore, upon turning ON and OFF of the first switch and the second switch, the positive polarity DC voltage or the negative polarity DC voltage can be supplied immediately to the electrode. Thus, as a result of switching carried out by the first switch and the second switch, the voltage value applied to the electrode is changed quickly to a positive polarity DC voltage or a negative polarity DC voltage. In this manner, the switching time is shortened, and since the voltage value applied to the electrode can be changed quickly to a positive polarity DC voltage or a negative polarity DC voltage, the charge removal capability of the ionizer can be improved.

Further, by continuously generating the positive polarity DC voltage and the negative polarity DC voltage and by shortening the switching time, the time for discharging of the first DC voltage generating circuit or the second DC voltage generating circuit, and the time for the first DC voltage generating circuit or the second DC voltage generating circuit to be turned ON can be prevented from being influenced by the first resistor, the second resistor, and stray capacitance, or by the capacitors that constitute the first DC voltage generating circuit and the second DC voltage generating circuit, and line resistance.

In this manner, with the present invention, by inserting the switch unit between the electrode and the first resistor and the second resistor, generation of heat in the first resistor and the second resistor can be suppressed, together with shortening the switching time and improving responsiveness. As a result, the charge removal capability of the ionizer can be improved.

The ionizer may include a switch control circuit for controlling ON and OFF timings of the first switch and the second switch, wherein the first switch and the second switch are preferably semiconductor switching elements, which are turned ON or OFF by control signals supplied from the switch control circuit. Semiconductor switching elements (e.g., Si transistors having a withstand voltage on the order of 4000 V) comprising power output transistors, FETs (Field Effect Transistors), or MOSFETs (Metal Oxide Semiconductor FETs), are capable of high-speed response, and therefore can easily obtain the aforementioned effect of shortening the switching time.

Further, the first DC voltage generating circuit and the second DC voltage generating circuit preferably are Cockcroft-Walton circuits which, for example, are constituted from capacitors and diodes arranged as a multi-stage rectifying circuit in which the capacitors are stacked in series.

In this case, for enabling the DC voltage to be stepped down in voltage to the voltage needed for generating ions in the vicinity of the electrode, the number of capacitor stages that make up the Cockcroft-Walton circuits can simply be reduced. Accordingly, in the case of using Cockcroft-Walton circuits, the values of voltages generated by the first DC voltage generating circuit and the second DC voltage generating circuit can easily be reduced.

Moreover, for use as the first DC voltage generating circuit and the second DC voltage generating circuit, instead of Cockcroft-Walton circuits, different types of DC high voltage generating circuits such as double-voltage rectifier circuits or the like can be adopted.

Further, the aforementioned ionizer may include an AC voltage generating circuit that generates an AC voltage, and a transformer, a primary winding of which is connected to the AC voltage generating circuit. In this case, (1) as sets that are made up of one AC voltage generating circuit and one transformer each, the first DC voltage generating circuit is connected to a secondary winding of a transformer in one set, and the second DC voltage generating circuit is connected to a secondary winding of a transformer in another set. Alternatively, (2) the first DC voltage generating circuit and the second DC voltage generating circuit are connected in common to the secondary winding of the transformer in the one set.

In either of the above cases (1) and (2), the AC voltage generating circuit preferably generates the AC voltage continuously. If generated continuously in this manner, using the AC voltage, it becomes possible for the positive polarity DC voltage and the negative polarity DC voltage to be generated continuously.

Further, compared to the circuit configuration of case (1) above, with the circuit configuration of case (2), the AC voltage generating circuit and the transformer are reduced by one set, and thus the circuit configuration can be simplified, and the ionizer can be manufactured at a reduced cost. Alternatively, with the ionizer having the circuit configuration of case (1), in the event that one of the AC voltage generating circuit and transformer sets becomes damaged, by using the other AC voltage generating circuit and transformer set, the circuit configuration can be changed to the configuration of case (2), and the ionizer can continue to be used.

Preferably, the AC voltage generating circuit comprises an inverter circuit, which converts a DC input voltage into the AC voltage, and then outputs the AC voltage to the primary winding of the transformer.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

A preferred embodiment of an ionizer according to the present invention will be described in detail below with reference to the accompanying drawings.

Configuration of Present Embodiment

Figure 1:
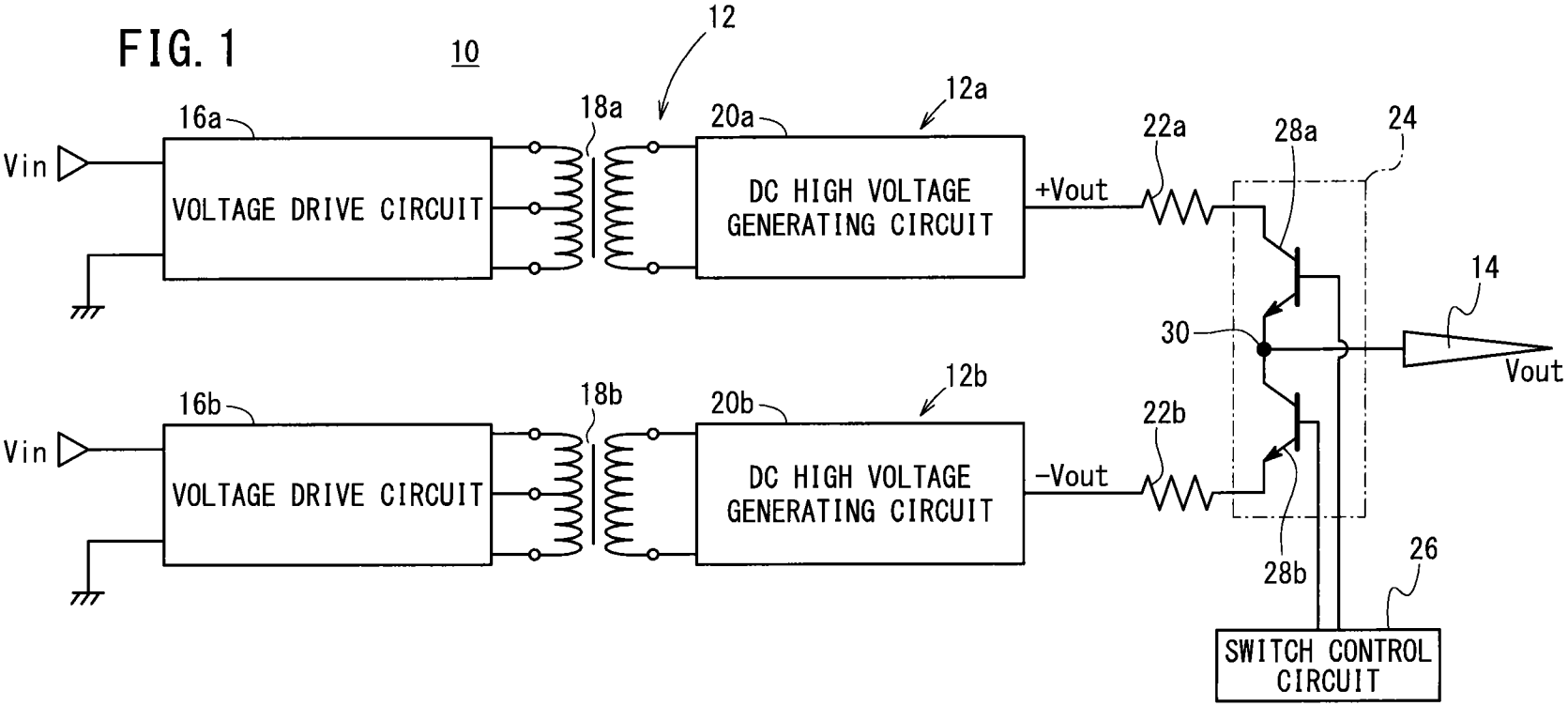
FIG. 1 is a circuit diagram of an ionizer according to an embodiment of the present invention.

As shown in FIG. 1, an ionizer 10 according to the present embodiment is constituted from a DC high voltage generator 12 which generates a DC high voltage, and a needle electrode 14 to which the generated DC high voltage (output voltage) $V_{out}$ is applied. When the output voltage $V_{out}$ is applied to the needle electrode 14, ions are generated in the vicinity of the needle electrode 14, and upon release of the generated ions toward an object to be neutralized (i.e., an object from which static charges are to be removed), electric charges accumulated in the object can be neutralized, and static charges can be removed from the object to be neutralized.

The DC high voltage generator 12 includes a positive polarity voltage generator 12*a*, which generates a positive polarity output voltage $+V_{out}$ (which is a positive polarity DC high voltage, hereinafter also referred to simply as a "positive polarity voltage $+V_{out}$"), and a negative polarity voltage generator 12*b*, which generates a negative polarity output voltage $-V_{out}$ (which is a negative polarity DC high voltage, hereinafter also referred to simply as a "negative polarity voltage $-V_{out}$").

The positive polarity voltage generator 12*a* includes a voltage drive circuit 16*a* (AC voltage generating circuit), which functions as an inverter circuit for converting a DC voltage $V_{in}$ (DC input voltage) into an AC voltage, a transformer 18*a* for raising or stepping up the AC voltage generated by the voltage drive circuit 16*a*, and a DC high voltage generating circuit 20*a* (first DC voltage generating circuit), which rectifies the raised AC voltage and generates the positive polarity voltage $+V_{out}$.

The negative polarity voltage generator 12*b* includes a voltage drive circuit 16*b* (AC voltage generating circuit), which functions as an inverter circuit for converting a DC voltage $V_{in}$ (DC input voltage) into an AC voltage, a transformer 18*b* for raising or stepping up the AC voltage generated by the voltage drive circuit 16*b*, and a DC high voltage generating circuit 20*b* (second DC voltage generating circuit), which rectifies the raised AC voltage and generates the negative polarity voltage $-V_{out}$.

The DC high voltage generating circuits 20*a*, 20*b* preferably are Cockcroft-Walton circuits which, for example, are constituted from capacitors and diodes arranged as a multi-stage rectifying circuit in which the capacitors are stacked in series. Alternatively, double-voltage rectifier circuits may be used. Either case is acceptable, insofar as the DC high voltage generating circuits are capable of converting an AC voltage into a DC high voltage.

An output resistor 22*a* (first resistor), which serves as a current limiting resistor for the purpose of protecting the circuitry of the positive polarity voltage generator 12*a*, is connected to the output side of the DC high voltage generating circuit 20*a*. An output resistor 22*b* (second resistor), which serves as a current limiting resistor for the purpose of protecting the circuitry of the negative polarity voltage generator 12*b*, is connected to the output side of the DC high voltage generating circuit 20*b*.

A switch unit 24 is disposed between the needle electrode 14 and the output resistors 22*a*, 22*b*. A switch control circuit 26 controls the switch unit 24. The switch unit 24 includes a first switch 28*a*, which is capable of establishing an electrical connection between the output resistor 22*a* and the needle electrode 14, and a second switch 28*b*, which is capable of establishing an electrical connection between the output resistor 22*b* and the needle electrode 14. The first switch 28*a* and the second switch 28*b* preferably are semiconductor switching elements (e.g., Si transistors having a withstand voltage on the order of 4000 V) comprising transistors, FETs, MOSFETs, or the like, which are turned ON and OFF by control signals supplied from the switch control circuit 26. In the drawings, reference numeral 30 indicates a connection point between the needle electrode 14 and the first and second switches 28*a*, 28*b*.

Accordingly, in the case that the switch control circuit 26 supplies a control signal to the first switch 28*a*, the first switch 28*a* is turned ON, and a state of conduction is established between the DC high voltage generating circuit 20*a*, the output resistor 22*a*, and the needle electrode 14. On the other hand, in the case that the switch control circuit 26 supplies a control signal to the second switch 28*b*, the second switch 28*b* is turned ON, and a state of conduction is established between the DC high voltage generating circuit 20*b*, the output resistor 22*b*, and the needle electrode 14.

Figure 2:
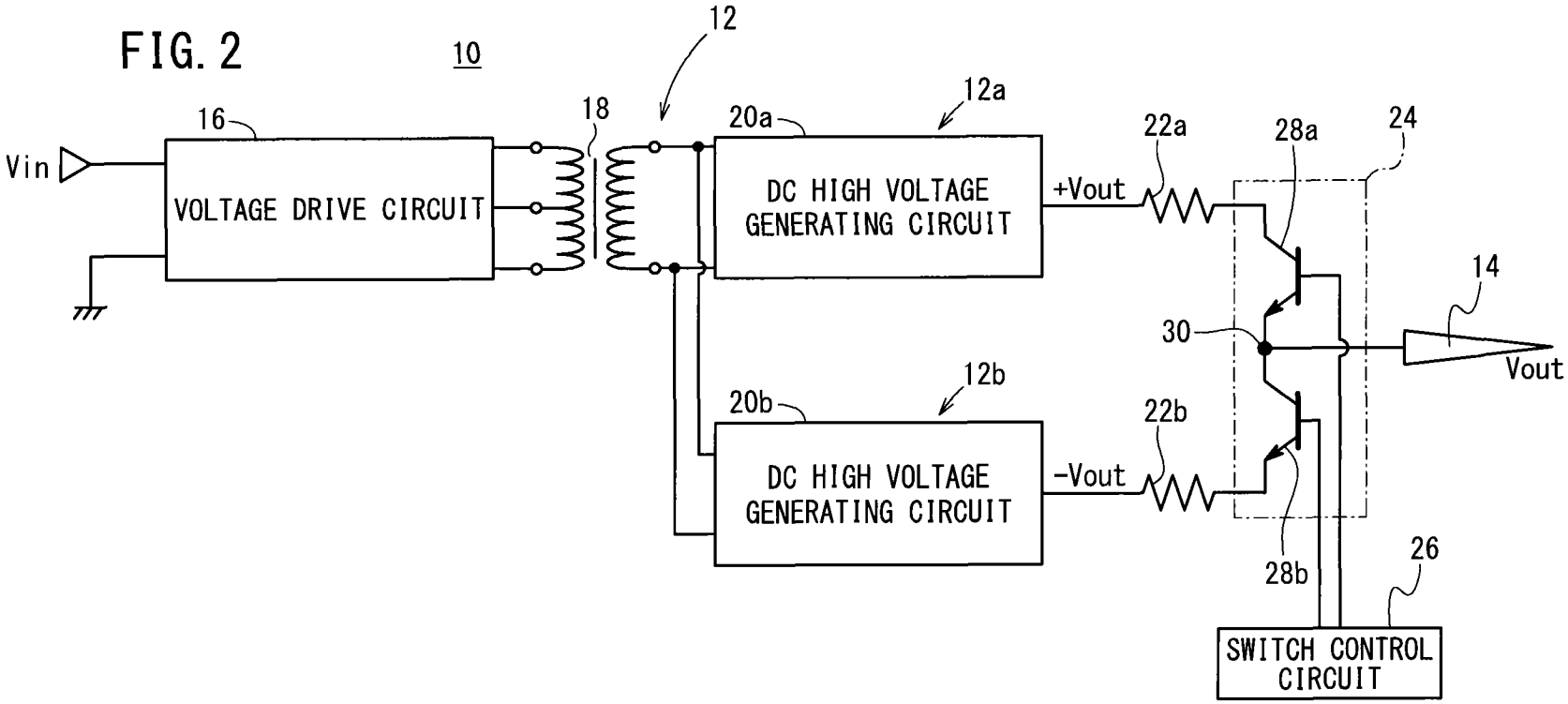
FIG. 2 is a circuit diagram of a modification of the ionizer shown in FIG. 1.

As noted above, the structure from the voltage drive circuit 16*a* up to the transformer 18*a* in the positive polarity voltage generator 12*a*, and the structure from the voltage drive circuit 16*b* up to the transformer 18*b* in the negative polarity voltage generator 12*b* are substantially identical. Thus, in the present embodiment, as shown in FIG. 2, a configuration may also be provided in which a single voltage drive circuit 16 and a single transformer 18 are used in common together with the positive polarity voltage generator 12*a* and the negative polarity voltage generator 12*b*, and in which the DC high voltage generating circuits 20*a*, 20*b* are connected in parallel with the secondary winding of the transformer 18.

Operation of the Present Embodiment

The ionizer 10 according to the present embodiment is constructed as described above. Next, a description shall be given concerning operations of the ionizer 10.

Figure 3:
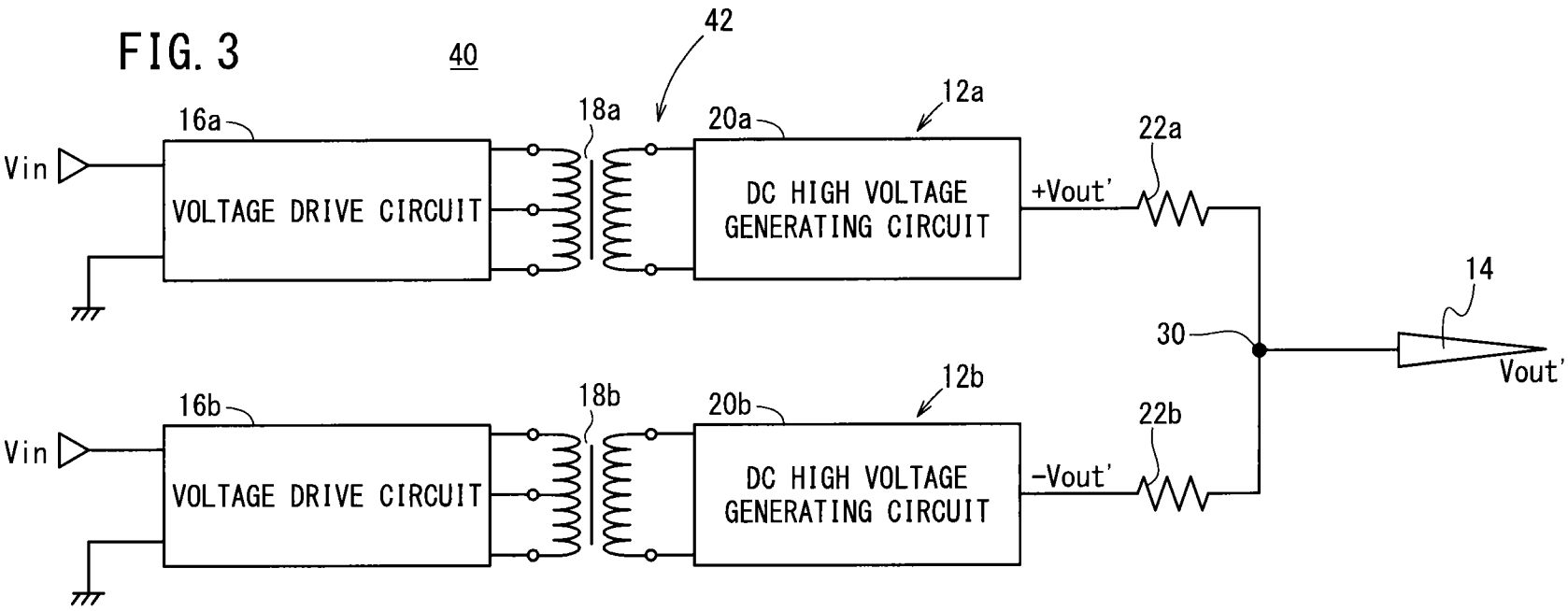
FIG. 3 PRIOR ART
FIG. 3 is a circuit diagram of an ionizer according to a comparative example.

FIG. 3 is a circuit diagram of an ionizer 40 according to a comparative example, which differs from the ionizer 10 according to the present embodiment (see FIGS. 1 and 2), in that the switch unit 24 and the switch control circuit 26 are not provided between the needle electrode 14 and the output resistors 22*a*, 22*b*.

Figure 4:
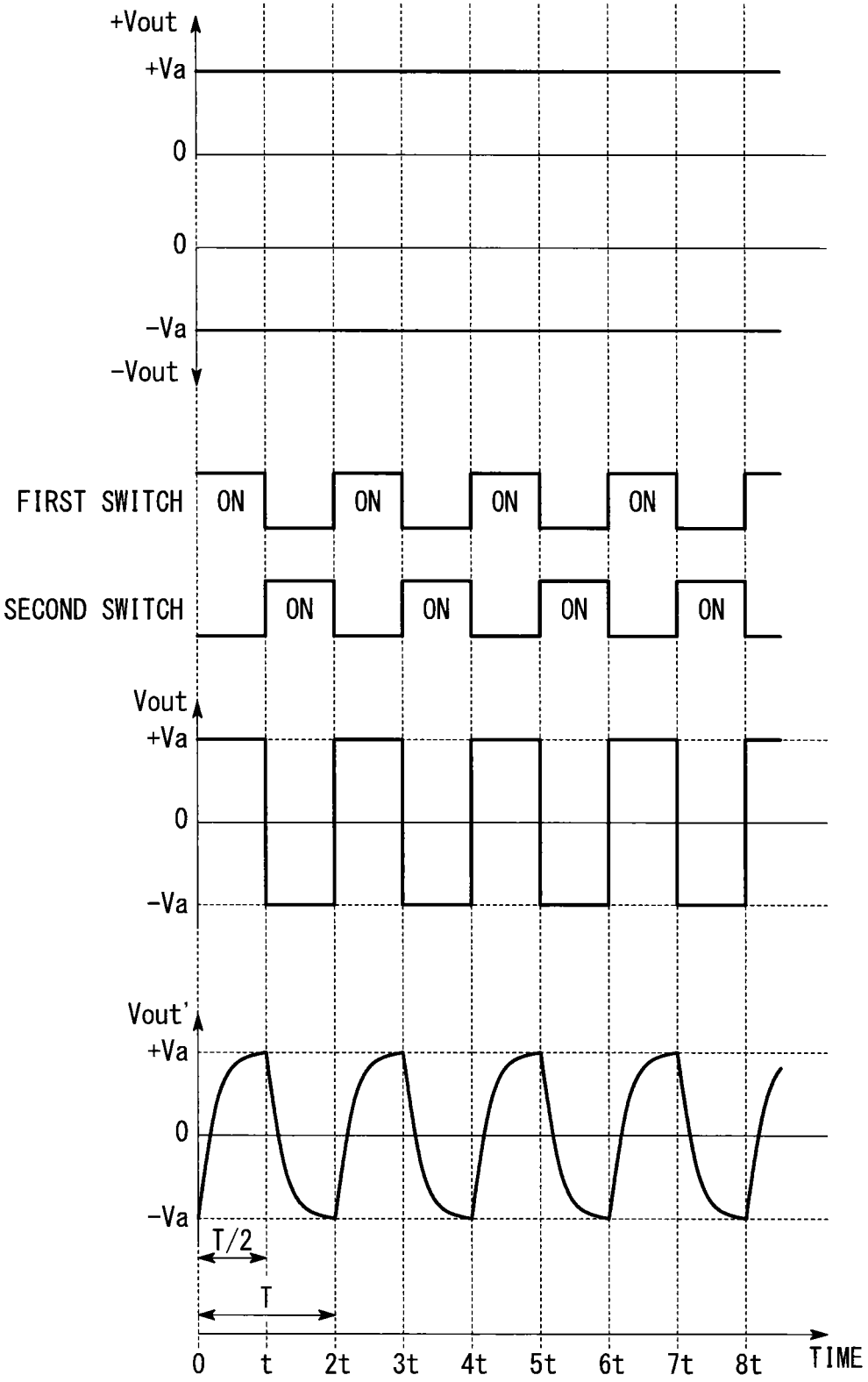
FIG. 4 is a time chart showing times at which an output voltage applied to a needle electrode is changed, in relation to the present embodiment and the comparative example.

FIG. 4 is a time chart for explaining operations of the ionizer 10 according to the present embodiment and the ionizer 40 according to the comparative example, and in particular, for explaining operations by which output voltages $V_{out}$, $V_{out}'$ are output.

With the ionizer 10 according to the present embodiment, in the case that removal of static charges is to be carried out with respect to a non-illustrated object to be neutralized, a DC voltage $V_{in}$ is continuously supplied to the voltage drive circuits 16, 16*a*, 16*b*. Consequently, the voltage drive circuits 16, 16*a*, 16*b*, which function as inverters, convert the DC voltage Vin into an AC voltage, and the AC voltage is output to the primary winding of the transformers 18, 18*a*, 18*b*. The transformers 18, 18*a*, 18*b* step up the AC voltage supplied to the primary winding thereof, and after being raised in value, the stepped-up AC voltage is supplied to the DC high voltage generating circuits 20*a*, 20*b*.

During operation of the ionizer 10, and more specifically, in order to carry out removal of static charges from the object to be neutralized, during the period that the DC high voltage generating circuits 20*a*, 20*b* continuously supply the DC voltage $V_{in}$ to the voltage drive circuits 16, 16*a*, 16*b*, operations are carried out continuously to convert the stepped-up AC voltage at the secondary winding side of the transformers 18, 18*a*, 18*b* into the positive polarity voltage $+V_{out}$ or the negative polarity voltage $-V_{out}$, and to output the same to the output resistors 22*a*, 22*b*.

In FIG. 4, as one example, a case is shown in which the DC high voltage generating circuit 20*a* continuously outputs a positive polarity voltage $+V_{out}$ having a voltage value of +Va, and the DC high voltage generating circuit 20*b* continuously outputs a negative polarity voltage $-V_{out}$ having a voltage value of −Va.

The switch control circuit 26 alternately outputs at predetermined time intervals (T/2 as shown in FIG. 4) control signals with respect to the first switch 28*a* and the second switch 28*b*, for turning ON the transistor, the FET or the MOSFET thereof. Consequently, within the period T, the first switch 28*a* and the second switch 28*b* are turned ON alternately at respective timings T/2 each. More specifically, within the period T, the first switch 28*a* is turned ON and the second switch 28*b* is turned OFF in a time band defined by the first half T/2 of the period T, whereas the second switch 28*b* is turned ON and the first switch 28*a* is turned OFF in a time band defined by the latter half T/2 of the period T.

As a result, during the time band in which the first switch 28*a* is turned ON, the DC high voltage generating circuit 20*a* can apply the positive polarity voltage $+V_{out}$ having a voltage value of +Va to the needle electrode 14 through the output resistor 22*a*, the first switch 28*a* and the connection point 30. On the other hand, during the time band in which the second switch 28*b* is turned ON, the DC high voltage generating circuit 20*b* can apply the negative polarity voltage $-V_{out}$ having a voltage value of −Va to the needle electrode 14 through the output resistor 22*b*, the second switch 28*b* and the connection point 30.

Accordingly, as shown in FIG. 4, the output voltage $V_{out}$ applied to the needle electrode 14 is a square wave DC voltage, which switches between the voltage values +Va and −Va at each T/2 time period. As discussed previously, the DC high voltage generating circuits 20*a*, 20*b* continue to output the positive polarity voltage $+V_{out}$ or the negative polarity voltage $-V_{out}$ during operation of the ionizer 10. Therefore, the time (switching time) required for the voltage polarity of the output voltage $V_{out}$ to be switched depends on the switching times of the first switch 28*a* and the second switch 28*b*.

The first switch 28*a* and the second switch 28*b* are semiconductor switching elements such as transistors, FETs, MOSFETs, or the like. For this reason, the switching times thereof are comparatively short, and thus the switching time required for switching the polarity of the output voltage $V_{out}$ can easily be shortened. Consequently, the voltage polarity of the output voltage $V_{out}$ can be switched rapidly.

During the time band that the positive polarity voltage $+V_{out}$ is applied to the needle electrode 14, positive ions are generated in the vicinity of the needle electrode 14, whereas during the time band that the negative polarity voltage $-V_{out}$ is applied to the needle electrode 14, negative ions are generated in the vicinity of the needle electrode 14. Consequently, by the ionizer 10 releasing the generated positive ions or negative ions toward the object to be neutralized, static charges, which charge the object to be neutralized, can be removed and the object can be neutralized.

On the other hand, with the ionizer 40 according to the comparative example, the switch unit 24 and the switch control circuit 26 are not provided. Therefore, for example, during each time period T/2, it can be contemplated to supply and to halt supply of the DC voltage $V_{in}$ repeatedly with respect to the voltage drive circuits 16*a*, 16*b*, whereby the polarity can be switched between the positive polarity output voltage $+V_{out}'$ and the negative polarity output voltage $-V_{out}'$.

However, with such a switching method, the output voltage $V_{out}'$ applied to the needle electrode 14 becomes attenuated, due to a time delay caused by the output resistors 22*a*, 22*b* and stray capacitance, or due to a time delay caused by the capacitors that make up the DC high voltage generating circuits 20*a*, 20*b*, and line resistance. As a result, the time to reach the voltage necessary to generate positive ions or negative ions in the vicinity of the needle electrode 14 becomes longer, the efficiency at which positive ions or negative ions are generated decreases, and the charge removal capability of the ionizer 40 becomes deteriorated.

In contrast to the comparative example, with the ionizer 10 according to the present embodiment, the positive polarity voltage $+V_{out}$ and the negative polarity voltage $-V_{out}$ are output continuously from the DC high voltage generating circuits 20*a*, 20*b*, and using the switch unit 24 and the switch control circuit 26, switching of the conductive state between the needle electrode 14 and the DC high voltage generating circuits 20*a*, 20*b* is carried out. Owing thereto, in each time period T/2, the polarity of the output voltage $V_{out}$ applied to the needle electrode 14 can be switched rapidly. Consequently, assuming that the voltage values +Va, −Va are greater than values needed to generate positive ions or negative ions in the vicinity of the needle electrode 14, then positive ions or negative ions can reliably be generated roughly within the time period T/2. As a result, the ion generation efficiency of the positive ions or the negative ions can be improved, and the charge removal (i.e., static charge neutralization) capability of the ionizer 10 can be enhanced.

Effects of the Present Embodiment

As has been described above, in the ionizer 10 according to the present embodiment, the DC high voltage generating circuits 20*a*, 20*b* are always in a state of operation (energized state) during operation of the ionizer 10 (while static charge removal is carried out with respect to an object to be neutralized). As a result, if the first switch 28*a* or the second switch 28*b* is turned ON, the positive polarity voltage $+V_{out}$ generated by the DC high voltage generating circuit 20*a*, or the negative polarity voltage $-V_{out}$ generated by the DC high voltage generating circuit 20*b* can be applied without modification to the needle electrode 14.

In addition, the first switch 28*a* and the second switch 28*b* are turned ON in mutually different time bands. Owing thereto, current that flows in the output resistor 22*a* can be prevented from flowing into the DC high voltage generating circuit 20*b* via the output resistor 22*b*, or current that flows in the output resistor 22*b* can be prevented from flowing into the DC high voltage generating circuit 20*a* via the output resistor 22*a*.

In this manner, the value of the output voltage $V_{out}$ applied to the needle electrode 14 becomes the value (+Va, −Va) of the positive polarity voltage $+V_{out}$ or the negative polarity voltage $-V_{out}$. For this reason, it becomes unnecessary to raise the DC voltage for the purpose of compensating a voltage decrease, as in Japanese Laid-Open Patent Publication No. 2000-058290. Accordingly, the DC high voltage generating circuits 20*a*, 20*b* are capable of lowering the positive polarity voltage $+V_{out}$ and the negative polarity voltage $-V_{out}$ to voltage values necessary for generating positive ions or negative ions in the vicinity of the needle electrode 14. More specifically, with the present embodiment, compared to the disclosure of Japanese Laid-Open Patent Publication No. 2000-058290, the values of the positive polarity voltage $+V_{out}$ and the negative polarity voltage $-V_{out}$ generated by the DC high voltage generating circuits 20*a*, 20*b* can be reduced, while preserving and ensuring the charge removal capability of the ionizer 10.

As a result, values of the currents that flow respectively in the output resistors 22*a*, 22*b* are decreased, thereby lowering power consumption of the ionizer 10, and the amount of heat generated by the output resistors 22*a*, 22*b* can be suppressed. Consequently, a rise in the temperature of the casing of the ionizer 10, in which the DC high voltage generating circuits 20*a*, 20*b* or the like are housed, can be suppressed.

Further, by turning ON and OFF the first switch 28*a* and the second switch 28*b* that make up the switch unit 24, the output voltage $V_{out}$ supplied to the needle electrode 14 is switched between the positive polarity voltage $+V_{out}$ or the negative polarity voltage $-V_{out}$. Owing thereto, the timing at which the DC high voltage generating circuit 20*a* and the DC high voltage generating circuit 20*b* are switched with respect to the needle electrode 14 (i.e., the timing at which the positive polarity voltage $+V_{out}$ and the negative polarity voltage $-V_{out}$ are switched with respect to the needle electrode 14) is made dependent on the switching times of the first switch 28*a* and the second switch 28*b*. Accordingly, by adopting as the first switch 28*a* and the second switch 28*b* high speed responsive semiconductor switching elements such as transistors, FETs, MOSFETs, or the like, the withstand voltages of which are higher than the positive polarity voltage $+V_{out}$ and the negative polarity voltage $-V_{out}$, the switching time can easily be shortened.

Further, as has been described above, with the present embodiment, during operation of the ionizer 10, the DC high voltage generating circuits 20*a*, 20*b* continuously generate the positive polarity voltage $+V_{out}$ and the negative polarity voltage $-V_{out}$. Therefore, upon turning ON and OFF of the first switch 28*a* and the second switch 28*b*, the positive polarity voltage $+V_{out}$ or the negative polarity voltage $-V_{out}$ can be supplied immediately to the needle electrode 14. More specifically, as a result of the ON and OFF switching carried out by the first switch 28*a* and the second switch 28*b*, the value of the output voltage $V_{out}$ applied to the needle electrode 14 is changed quickly to the positive polarity voltage $+V_{out}$ or the negative polarity voltage $-V_{out}$. In this manner, the switching time is shortened, and since the voltage value applied to the needle electrode 14 can be changed quickly to the positive polarity voltage $+V_{out}$ or the negative polarity voltage $-V_{out}$, the charge removal capability of the ionizer 10 can be improved.

Further, by continuously generating the positive polarity voltage $+V_{out}$ and the negative polarity voltage $-V_{out}$ and by shortening the switching time, the time for discharging of the DC high voltage generating circuits 20*a*, 20*b* and the time for the DC high voltage generating circuits 20*a*, 20*b* to be turned ON can be prevented from being influenced by the output resistors 22*a*, 22*b* and stray capacitance, or being influenced by the capacitors that constitute the DC high voltage generating circuits 20*a*, 20*b* and line resistance.

In this manner, with the present embodiment, by inserting the switch unit 24 and the switch control circuit 26 between the needle electrode 14 and the output resistors 22*a*, 22*b*, generation of heat in the output resistors 22*a*, 22*b* can be suppressed, together with shortening the switching time and improving responsiveness. As a result, the charge removal capability of the ionizer 10 can be improved.

Further, in the case that the DC high voltage generating circuits 20*a*, 20*b* are Cockcroft-Walton circuits, for enabling the output voltage $V_{out}$ to be stepped down to a voltage needed for generating positive ions or negative ions in the vicinity of the needle electrode 14, the number of capacitor stages that make up the Cockcroft-Walton circuits can simply be reduced (for example, the circuits can be changed from seven stages to four stages). In this manner, in the case of using Cockcroft-Walton circuits, the values of the positive polarity voltage $+V_{out}$ and the negative polarity voltage $-V_{out}$ generated by the DC high voltage generating circuits 20*a*, 20*b* can easily be reduced.

Further, in the modified embodiment shown in FIG. 2, compared to the configuration of FIG. 1, the assembly made up of the voltage drive circuit and the transformer is reduced by one set, and therefore, the circuit structure can be simplified and the ionizer 10 can be manufactured at a reduced cost. On the other hand, with the configuration of FIG. 1, in the event that one of the voltage drive circuit and transformer sets becomes damaged, by using the other voltage drive circuit and transformer set, the circuit configuration can be changed to the configuration shown in FIG. 2, and the ionizer 10 can continue to be used.

The ionizer according to the present invention is not limited to the above embodiment. Various changes and modifications may be made to the embodiment without departing from the scope of the invention as set forth in the appended claims.

What is claimed is:

1. An ionizer that generates ions in the vicinity of an electrode through application of a voltage to the electrode, comprising:

a first DC voltage generating circuit that generates a positive polarity DC voltage;

a second DC voltage generating circuit that generates a negative polarity DC voltage;

a first resistor connected to an output side of the first DC voltage generating circuit;

a second resistor connected to an output side of the second DC voltage generating circuit; and a switch unit that connects the first resistor and the second resistor with the electrode, wherein:

the first DC voltage generating circuit continuously generates the positive polarity DC voltage during operation of the ionizer and continuously outputs the generated positive polarity DC voltage to the first resistor;

the second DC voltage generating circuit continuously generates the negative polarity DC voltage during operation of the ionizer and continuously outputs the generated negative polarity DC voltage to the second resistor;

an absolute value of the positive polarity DC voltage is approximately equal to the absolute value of the negative polarity DC voltage the switch unit is equipped with a first switch capable of establishing a connection between the first resistor and the electrode, and a second switch capable of establishing a connection between the second resistor and the electrode; and the first switch and the second switch are turned ON in mutually different time bands, respectively.

2. The ionizer according to claim 1, further comprising:

a switch control circuit for controlling ON and OFF timings of the first switch and the second switch, wherein the first switch and the second switch are semiconductor switching elements, which are turned ON or OFF by control signals supplied from the switch control circuit.

3. The ionizer according to claim 1, wherein the first DC voltage generating circuit and the second DC voltage generating circuit are Cockcroft-Walton circuits.

4. The ionizer according to claim 1, further comprising:

an AC voltage generating circuit that generates an AC voltage; and a transformer, a primary winding of which is connected to the AC voltage generating circuit, wherein:

as sets that are made up of one AC voltage generating circuit and one transformer each, the first DC voltage generating circuit is connected to a secondary winding of a transformer in one set, and the second DC voltage generating circuit is connected to a secondary winding of a transformer in another set, or alternatively, the first DC voltage generating circuit and the second DC voltage generating circuit are connected in common to the secondary winding of the transformer in the one set; and the AC voltage generating circuit generates the AC voltage continuously.

5. The ionizer according to claim 4, wherein the AC voltage generating circuit comprises an inverter circuit, which converts a DC input voltage into the AC voltage, and outputs the AC voltage to the primary winding of the transformer.

6. The ionizer according to claim 1, wherein the first DC voltage generating circuit continuously generates the positive polarity DC voltage at a same time that the second DC voltage generating circuit continuously generates the negative polarity DC voltage.

* * * * *